US008248312B2

(12) United States Patent
Guan et al.

(10) Patent No.: US 8,248,312 B2
(45) Date of Patent: Aug. 21, 2012

(54) ANTENNA AND WIRELESS COMMUNICATION APPARATUS

(75) Inventors: Ning Guan, Chiba (JP); Koichi Ito, Chiba (JP)

(73) Assignees: Fujikura Ltd., Tokyo (JP); Chiba University, Chiba-shi, Chiba (JP)

( * ) Notice: Subject to any disclaimer, the term of this patent is extended or adjusted under 35 U.S.C. 154(b) by 462 days.

(21) Appl. No.: 12/551,800

(22) Filed: Sep. 1, 2009

(65) Prior Publication Data

US 2010/0214174 A1 Aug. 26, 2010

(30) Foreign Application Priority Data

Feb. 24, 2009 (JP) ..... 2009-041279

(51) Int. Cl.
*H01Q 1/24* (2006.01)
*H01Q 1/36* (2006.01)

(52) U.S. Cl. ..... 343/702; 343/846; 343/895

(58) Field of Classification Search ..... 343/702, 343/846, 895, 700 MS
See application file for complete search history.

(56) References Cited

U.S. PATENT DOCUMENTS 6,734,825 B1 * 5/2004 Guo et al. ..... 343/700 MS
7,109,923 B2 * 9/2006 Ollikainen et al. .... 343/700 MS

OTHER PUBLICATIONS

Wu, Chih-Hsien et al.,; "Low-Profile Printed Monopole Antenna for Penta-Band Operation in the Mobile Phone"; IEEE AP-S Int. Symp., pp. 3540-3543, 2007.

Lin, Chun-I et al.; "Printed Monopole Slot Antenna for Multiband Operation in the Mobile Phone"; IEEE AP-S Int. Symp., pp. 629-632, 2007.

Deng, Heng et al.; "A Triple- Band Compact Monopole Antenna for Mobile Handsets"; IEEE AP-S Int., pp. 2069-2072, 2007.

Tung, Hao-Chun et al.; "Shorted Monopole Antenna for Curved Shape Phone Housing in Clamshell Phone"; IEEE AP-S Int. Symp., pp. 1060-1063, 2007.

Lee, Hyun-Jeong et al.; "The Compact Quad-Band Planar Internal Antenna for Moblie Handsets"; IEEE AP-S Int. Symp., pp. 2045-2048, 2007.

Tang, I-Tseng et al.; "Compact Five-Band Meandered Pifa by Using Meandered Slots Structure"; IEEE AP-S Int. Symp., pp. 653-656, 2007.

Yoon, Seunghwan et al.; "Triple-Band Fractal Antenna Design for Handset System"; IEEE AP-S Int. Symp., pp. 813-816, 2007.

Guan, Ning et al.; "Film Antenna for Mobile Phone Applications"; Proceedings of the 1st European Wireless Technology Conference; Oct. 2008, Amsterdam, The Netherlands; pp. 139-142.

* cited by examiner

*Primary Examiner* — Hoang V Nguyen
(74) *Attorney, Agent, or Firm* — Westerman, Hattori, Daniels & Adrian, LLP

(57) ABSTRACT

The present invention provides an antenna that is small in size and has band frequencies corresponding to multibands, and a wireless communication apparatus including the antenna. The antenna according to the present invention has two radiation elements 12*a* and 12*b* connected to a ground plate 11 via a shorting pin. The two radiation elements 12*a* and 12*b* each have a lower arm and an upper arm that are formed through bending. The lower arm is connected to the shorting pin and is located closer to the ground plate 11 than the upper arm is. At least one of the lower arm and the upper arm has a meandered structure.

8 Claims, 20 Drawing Sheets x−y PLANE x−z PLANE y−z PLANE x-y PLANE x-z PLANE y-z PLANE x-y PLANE x-z PLANE y-z PLANE x-y PLANE x-z PLANE y-z PLANE x-y PLANE x-z PLANE y-z PLANE

ANTENNA AND WIRELESS COMMUNICATION APPARATUS

BACKGROUND OF THE INVENTION

1. Technical Field

The present invention relates to an antenna and a wireless communication apparatus, and more particularly, to a multiband antenna having two radiation elements, and a wireless communication apparatus including the multiband antenna.

2. Background Art

Various kinds of antennas that can cope with multibands have been suggested. Examples of such antennas include antennas each having meandered slots formed on a meandered patch (see Non-Patent Document 1, for example), monopole slot antennas (see Non-Patent Document 2, for example), antennas each using a plurality of monopoles (see Non-Patent Documents 3 through 5, for example), planar inverted-F antennas (PIFA) (see Non-Patent Document 6, for example), fractal antennas (see Non-Patent Document 7, for example), and film inverted-F antennas (see Non-Patent Document 8, for example).

CITATION LIST

Patent Documents

Non-Patent Document 1 I-T. Tang, D-B. Lin, W-L. Chen, J-H. Horng, and C-M. Li, "Compact Five-Band Meandered PIFA by Using Meandered Slots Structure", IEEE AP-S Int. Symp., pp. 653-656, 2007

Non-Patent Document 2 C-I. Lin, K-L. Wong, and S-H. Yeh, "Printed Monopole Slot Antenna for Multiband Operation in the Mobile Phone", IEEE AP-S Int. Symp., pp. 629-632, 2007

Non-Patent Document 3 C-H. Wu and K-L. Wong, "Low-Profile Printed Monopole Antenna for Penta-Band Operation in the Mobile Phone", IEEE AP-S Int. Symp., pp. 3540-3543, 2007

Non-Patent Document 4 H. Deng and Z. Feng, "A Triple-Band Compact Monopole Antenna for Mobile Handsets", IEEE AP-S Int. Symp., pp. 2069-2072, 2007

Non-Patent Document 5 H-C. Tung, T-F. Chen, C-Y. Chang, C-Y. Lin, and T-F. Huang, "Shorted Monopole Antenna for Curved Shape Phone Housing in Clamshell Phone", IEEE AP-S Int. Symp., pp. 1060-1063, 2007

Non-Patent Document 6H-J. Lee, S-H. Cho, J-K. Park, Y-H. Cho, J-M. Kim, K-H. Lee, I-Y. Lee, and J-S. Kim, "The Compact Quad-Band Planar Internal Antenna for Mobile Handsets", IEEE AP-S Int. Symp., pp. 2045-2048, 2007

Non-Patent Document 7 S. Yoon, C. Jung, Y. Kim, and F. D. Flaviis, "Triple-Band Fractal Antenna Design for Handset System", IEEE AP-S Int. Symp., pp. 813-816, 2007

Non-Patent Document 8 N. Guan, D. Delaune, H. Furuya, and K. Ito, "Film Antenna for Mobile Phone Applications", Proc. 1st European Wireless Technology Conf., pp. 139-141, 2008

DISCLOSURE OF THE INVENTION

Problems to be Solved by the Invention

An antenna to be mounted on a wireless communication apparatus needs to be small in size and have operating frequencies corresponding to multibands. However, a conventional antenna has a narrow operating band, and cannot cope with all the following bands: AMPS (824 to 894 MHz), GSM (880 to 960 MHz), DCS (1710 to 1880 MHz), PCS (1850 to 1990 MHz), and UMTS (1920 to 2170 MHz).

Also, it is desirable that antennas can be easily manufactured to reduce the cost of manufacturing. However, the manufacture of conventional antennas is not easy. For example, an antenna having meandered slots formed on a meandered patch has a complicated structure and contains a large number of parts. In a monopole slot antenna, slots are formed on a ground plate, and therefore, pressing and etching are required in the manufacturing process. In an antenna using a plurality of monopoles, a PIFA, or a fractal antenna, pressing and etching are also required in the manufacturing process, because there is a space between a radiation element and an adjacent metal material.

Therefore, the present invention aims to provide an antenna that is small in size and has operating frequencies corresponding to multibands, and a wireless communication apparatus including the antenna.

Means to Solve the Problems

To solve the above problems, an antenna according to the present invention is an antenna that has two radiation elements connected to a ground plate via a shorting pin. The two radiation elements each have a lower arm and an upper arm formed through bending. The lower arms of the two radiation elements are connected to the shorting pin and are located closer to the ground plate than the upper arms are. At least one of the lower arm and the upper arm of each of the two radiation elements has a meandered structure.

Since the antenna according to the present invention has the two radiation elements, the operating frequency band can be made wider than that in a case where only one radiation element is used. Accordingly, the antenna according to the present invention can be made small in size and can have band frequencies corresponding to multibands.

In the antenna according to the present invention, it is preferable that the two radiation elements each have substantially a planar structure, and are arranged parallel or perpendicular to each other.

In the antenna according to the present invention, it is preferable that the lower arms and the upper arms extend along straight lines parallel to each other, and at least one of the two radiation elements has a bent portion that is bent along a straight line parallel to the straight lines and toward the other one of the two radiation elements.

In the antenna according to the present invention, it is preferable that the meandered structure is placed parallel or perpendicular to the nearest edge of the ground plate.

In the antenna according to the present invention, it is preferable that the two radiation elements are formed with metal films or metal wires.

In the antenna according to the present invention, it is preferable that the two radiation elements each have substantially a planar structure, and are fixed to a dielectric material.

In the antenna according to the present invention, it is preferable that the face having the largest area in the two radiation elements is placed parallel or perpendicular to the ground plate.

To solve the above problems, a wireless communication apparatus according to the present invention includes the antenna according to the present invention.

EFFECT OF THE INVENTION

According to the present invention, it is possible to provide an antenna that is small in size and has operating frequencies corresponding to multibands, and a wireless communication apparatus including the antenna.

BRIEF DESCRIPTION OF THE DRAWINGS

FIG. 1 is a schematic view showing the structure of an antenna according to an embodiment.

FIG. 2 shows planar developments of the radiation elements according to the embodiment.

FIG. 4 shows embodiments of radiation elements.

FIG. 10 shows the radiation characteristics of the antenna according to Example 1 at the frequency of 0.860 GHz.

FIG. 11 shows the radiation characteristics of the antenna according to Example 1 at the frequency of 0.920 GHz.

FIG. 12 shows the radiation characteristics of the antenna according to Example 1 at the frequency of 1.795 GHz.

FIG. 13 shows the radiation characteristics of the antenna according to Example 1 at the frequency of 1.920 GHz.

FIG. 14 shows the radiation characteristics of the antenna according to Example 1 at the frequency of 2.045 GHz.

BEST MODE FOR CARRYING OUT THE INVENTION

The following is a description of embodiments of the present invention, with reference to the accompanying drawings. The embodiments described below are merely examples of structures according to the present invention, and the present invention is not limited to the following embodiments.

Figure 1B:
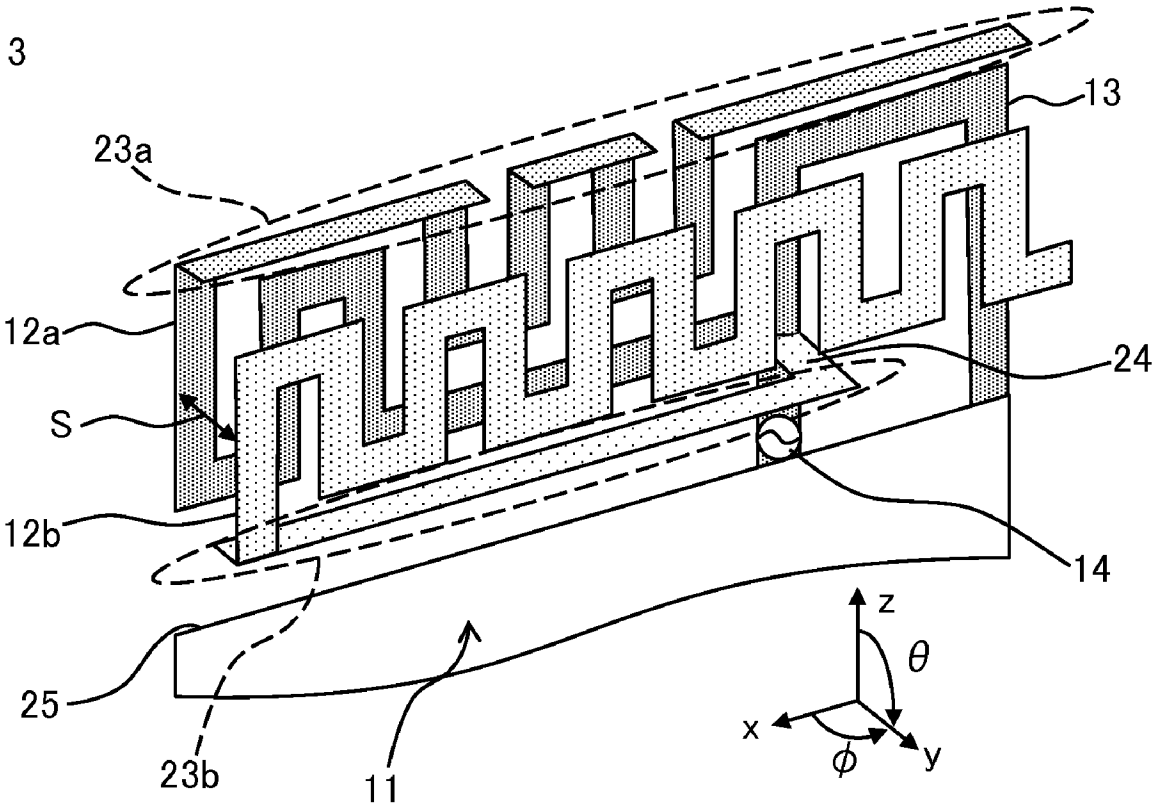
FIG. 1(B) is an enlarged view of the radiation elements and the surrounding area.
Figure 1A:
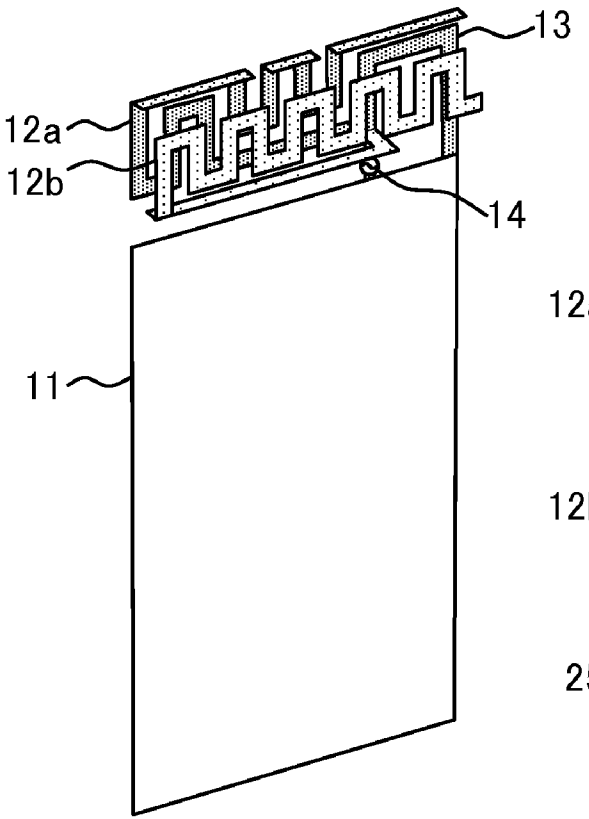
FIG. 1(A) is a bird's-eye view of the entire antenna.

Two radiation elements 12*a* and 12*b*, and a shorting pin 13 of an antenna according to this embodiment are formed with copper films. The thickness of the copper films is 10 μm. FIG. 1 is schematic views showing the structure of the antenna according to this embodiment: FIG. 1(A) is a bird's-eye view of the entire antenna; and FIG. 1(B) is an enlarged view of the radiation elements and the surrounding area. The antenna according to this embodiment includes a ground plate 11, the two radiation elements 12*a* and 12*b*, the shorting pin 13, and a feeding point 14. The two radiation elements 12*a* and 12*b* has power supplied from the feeding point 14 located between the ground plate 11 and the two radiation elements. The radiation element 12*a* and the radiation element 12*b* are connected to each other at a location near the feeding point 14 by a connecting portion 24.

It is preferable that each of the two radiation elements 12*a* and 12*b* has substantially a planar structure. Accordingly, the antenna can be made smaller in size. It is also preferable that the two radiation elements 12*a* and 12*b* are fixed to a dielectric material. With this arrangement, the antenna can be made even smaller in size.

Where each of the two radiation elements 12*a* and 12*b* has substantially a planar structure, it is preferable that the two radiation elements 12*a* and 12*b* are arranged parallel to each other, with a predetermined distance S being kept in between. For example, the two radiation elements 12*a* and 12*b* may be bonded to side faces of a tube-like structure that is rectangular in cross section, with the side faces facing each other. With this arrangement, the two radiation elements 12*a* and 12*b* are arranged parallel to each other.

Where each of the two radiation elements 12*a* and 12*b* has substantially a planar structure, it is also preferable that the two radiation elements 12*a* and 12*b* are placed perpendicular to each other. For example, the two radiation elements 12*a* and 12*b* may be bonded to side faces of a tube-like structure that is rectangular in cross section, with the side faces being adjacent to each other. In this case, it is possible to achieve the same effects as those achieved in the case where the two radiation elements 12*a* and 12*b* are arranged parallel to each other.

Of the planes in which the arms forming the two radiation elements 12*a* and 12*b* belong, it is preferable that the plane having the largest arm area is located parallel or perpendicular to the ground plate 11. For example, as shown in FIG. 1, the plane in which the largest face of the radiation elements 12*a* and 12*b* belongs is placed parallel to the ground plate 11. Alternatively, the face having the largest area in the radiation element 12*a* may be located parallel to the ground plate 11, while the face having the largest area in the radiation element 12*b* is placed perpendicular to the ground plate 11. In such a case, the radiation element 12*a* and the radiation element 12*b* may switch the places.

It is preferable that the two radiation elements 12*a* and 12*b* have a bent portion 23*a* and a bent portion 23*b*, respectively. The bent portion 23*a* is a portion of the radiation element 12*a* that is bent toward the other radiation element 12*b*. The bent portion 23*b* is a portion of the radiation element 12*b* that is bent toward the other radiation element 12*a*. With this arrangement, the antenna can be made smaller in size. However, only one of the two radiation elements 12*a* and 12*b* may have the bent portion 23*a* and the bent portion 23*b*.

Figure 2A:
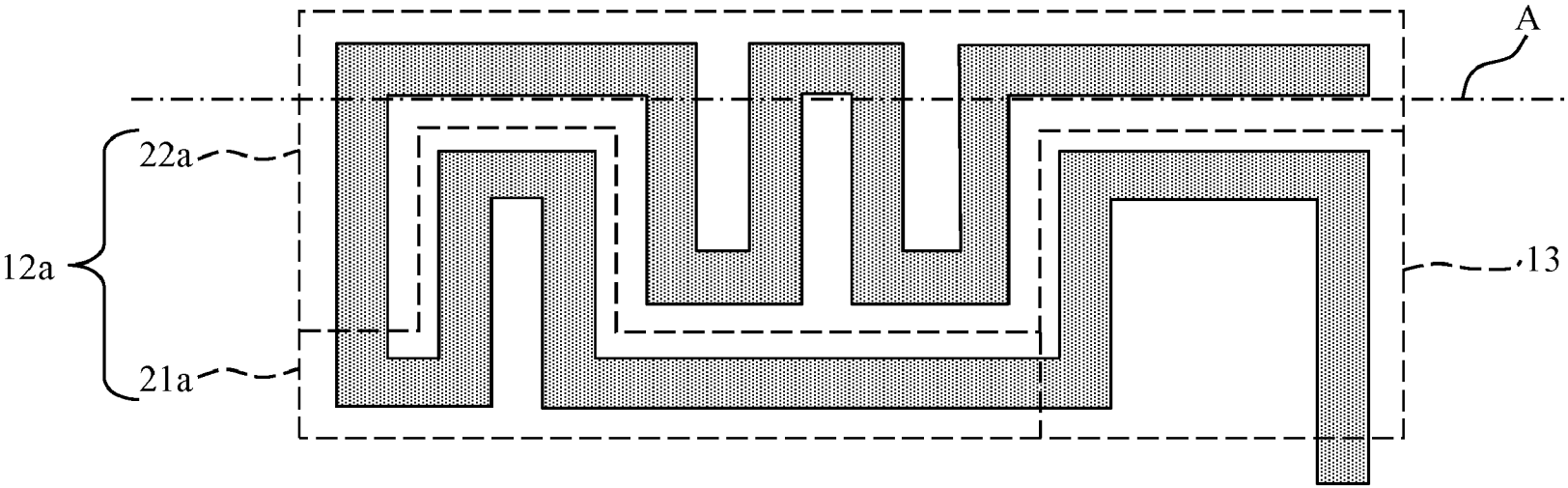
FIG. 2(A) shows the radiation element 12*a*.
Figure 2B:
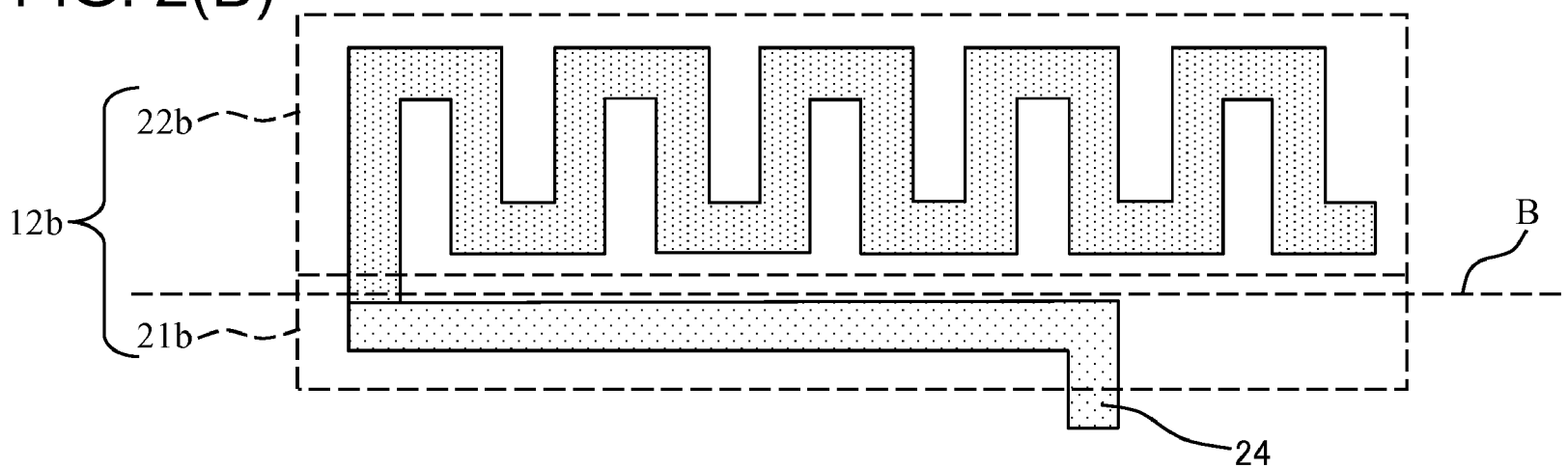
FIG. 2(B) shows the radiation element 12*b;*

FIG. 2 shows planar developments of the radiation elements according to this embodiment: FIG. 2(A) shows the radiation element 12*a*, and FIG. 2(B) shows the radiation element 12*b*. The radiation element 12*a* includes a lower arm 21*a* and an upper arm 22*a* that are formed through bending. The radiation element 12*b* includes a lower arm 21*b* and an upper arm 22*b* that are formed through bending.

The lower arm 21*a* and the lower arm 21*b* connect the upper arm 22*a* and the upper arm 22*b* to the feeding point (denoted by reference numeral 14 in FIG. 1(A)), respectively. The radiation elements 12*a* and 12*b* are connected to each other at a location near the feeding point 14. For example, the connecting portion 24 located at the top end of the lower arm 21*b* is connected to the lower arm 21*a*.

The two radiation elements 12*a* and 12*b* are connected to the ground plate 11 via the single shorting pin 13. The shorting pin 13 short-circuits the radiation elements 12*a* and 12*b*, and the ground plate 11. The lower arm 21*a* and the lower arm 21*b* are connected to the shorting pin 13, and are located closer to the ground plate 11 than the upper arm 22*a* and the upper arm 22*b* are.

To make the antenna smaller in size, a meandered structure is used as part of the arms forming the radiation element 12*a* and the radiation element 12*b*. For example, at least one of the lower arm 21*a* and the upper arm 22*a* of the radiation element 12*a* has a meandered structure. Also, at least one of the lower arm 21*b* and the upper arm 22*b* of the radiation element 12*b* has a meandered structure. The number and locations of meanders forming each meander structure are determined by the operating frequency of the antenna. If the shorting pin 13 of the antenna has a meandered structure, the operating frequency band of the antenna is widened. It is preferable that each meandered structure is located parallel or perpendicular to the nearest edge 25 of the ground plate 11.

It is preferable that the shorting pin 13 has a meandered structure. If the shorting pin 13 does not have a meandered structure, bandwidth of a desired frequency might not be achieved. Where the shorting pin 13 has a meandered structure, a second operating frequency band can be greatly widened.

It is preferable that the radiation element 12*a* is bent along straight line A. Also, it is preferable that the radiation element 12*b* is bent along straight line B. With this arrangement, bent portions (denoted by reference numerals 23*a* and 23*b* in FIG. 1) are formed. The straight lines A and B are straight lines running parallel to the extending direction of the lower arms 21 and the upper arms 22 in the later described fundamental structures of the radiation element 12*a* and the radiation element 12*b*. More specifically, the straight line A is a straight line running parallel to the extending direction of the lower arm 21*a* and the upper arm 22*a*. The straight line B is a straight line running parallel to the extending direction of the lower arm 21*b* and the upper arm 22*b*.

Although the two radiation elements 12*a* and 12*b* and the shorting pin 13 are formed with copper films in the above described embodiment, the material of the two radiation elements 12*a* and 12*b* may be any conductive material such as aluminum and the like, instead of copper. It is preferable that the thicknesses of the two radiation elements 12*a* and 12*b* and the shorting pin 13 are in the range of 10 μm to 50 μm. The effects of the present invention can also be achieved, if the two radiation elements 12*a* and 12*b* and the shorting pin 13 are formed with metal wires, instead of metal films. In such a case, it is preferable that the thicknesses of the metal wires are in the range of 0.5 mm to 2.5 mm, to secure structural strength and input band characteristics. Structures each having the two radiation elements 12*a* and 12*b* and the shorting pin 13 formed with metal wires can be manufactured at very low costs.

Figure 3:
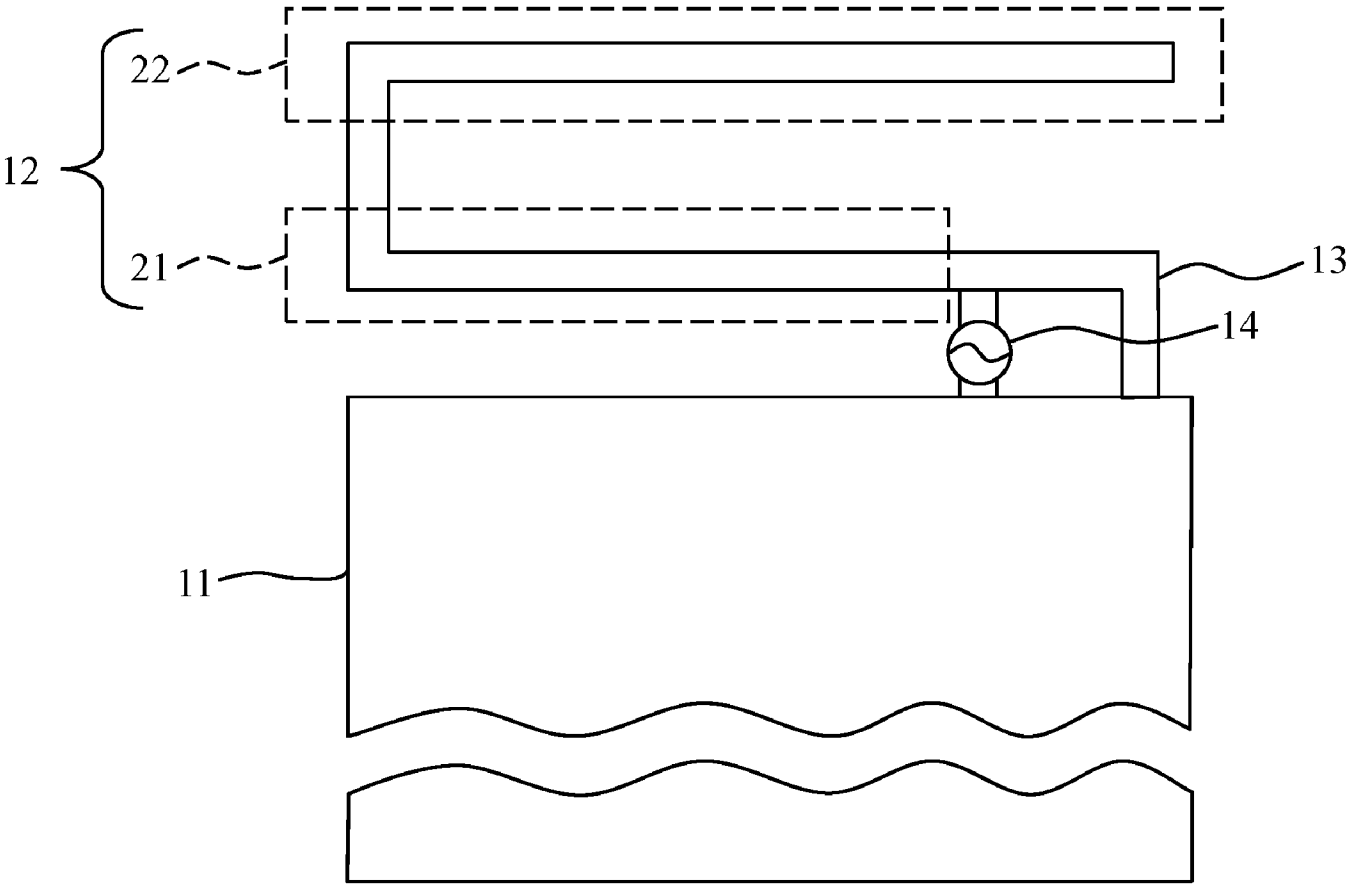
FIG. 3 is a schematic view showing an example fundamental structure of an antenna.
Figure 4A:
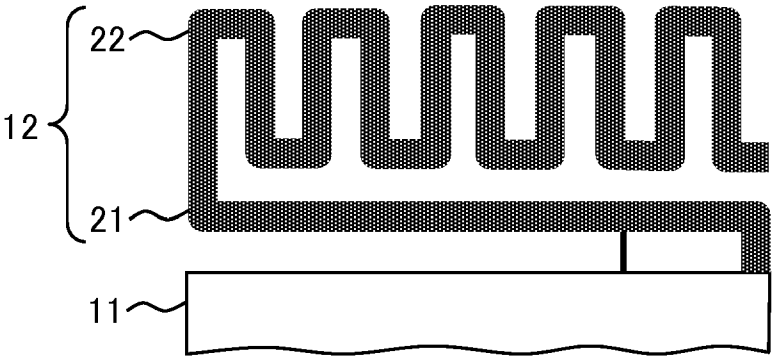
FIG. 4(A) shows a first embodiment.
Figure 4B:
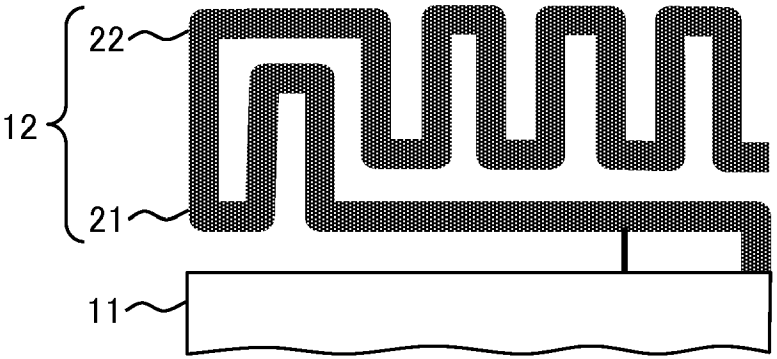
FIG. 4(B) shows a second embodiment.
Figure 4C:
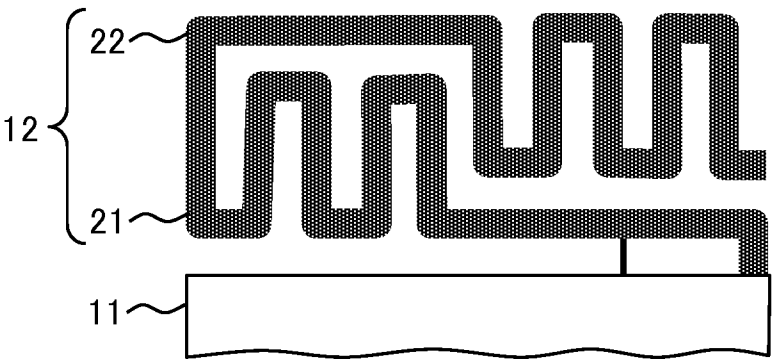
FIG. 4(C) shows a third embodiment.
Figure 4D:
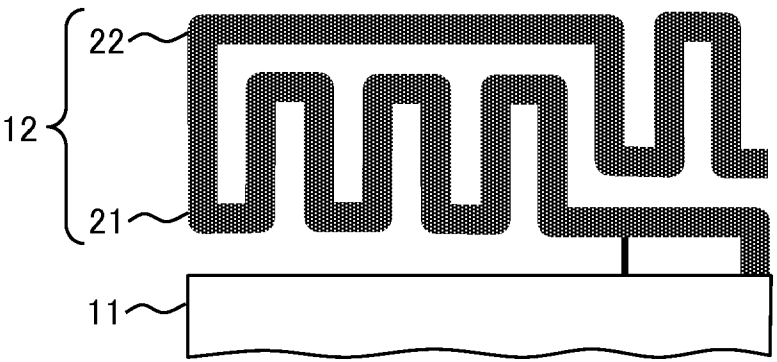
FIG. 4(D) shows a fourth embodiment.

FIG. 3 is a schematic view showing an example fundamental structure of an antenna. The radiation element 12*a* and the radiation element 12*b* illustrated in FIGS. 1 and 2 are based on the fundamental structure of the antenna shown in FIG. 3. A radiation element 12 has a lower arm 21 and an upper arm 22 formed through bending. The lower arm 21 is connected to a shorting pin 13, and is located closer to a ground plate 11 than the upper arm 22 is. The lower arm 21 and the upper arm 22 extend along straight lines that are parallel to each other. A straight line running parallel to the extending direction of the lower arm 21 and the upper arm 22 is equivalent to the straight lines A and B shown in FIG. 2.

The entire radiation element 12 including the lower arm 21 and the upper arm 22 contributes to a first operating frequency band in which the frequency is low. The total length of the radiation element 12 is approximately $\lambda_1/4$. Here, $\lambda_1$ represents the wavelength of the free space of electromagnetic waves at the center frequency of the first operating frequency band. Where a dielectric material exists near the radiation element 12, the wavelength is made shorter, and $\lambda_1$ represents the shortened wavelength in that case.

As the upper arm 22 is bent at the top end of the lower arm 21, the second operating frequency band greatly shifts to the low frequency side, compared with the second operating frequency band observed in a case where the upper arm 22 is not bent. Thus, the antenna according to this embodiment can be used in multibands. More specifically, if the upper arm 22 is not bent at the top end of the lower arm 21, the center frequency $f_2$ of the second operating frequency band is almost three times higher than the center frequency $f_1$ of the first operating band. In this case, the center frequency $f_2$ is 2.7 GHz while the center frequency $f_1$ is 0.9 GHz, and the antenna cannot cope with multibands.

Meanwhile, meandered structures are used in small-size antennas that are allowed to be placed only in limited spaces. This is to reduce the volume of each antenna. In the antenna according to this embodiment, meandered structures are used not only to reduce the antenna size, but also to adjust the operating frequency of the antenna. More specifically, meandered structures are used for one or both of the upper arm 22 and the lower arm 21. With this arrangement, the operating frequency of the antenna can be adjusted by changing the places of the meandered structures. Thus, adjustment of the resonance frequency becomes easier.

FIG. 4 shows embodiments of radiation elements. FIG. 4(A) shows a first embodiment, FIG. 4(B) shows a second embodiment, FIG. 4(C) shows a third embodiment, and FIG. 4(D) shows a fourth embodiment. The first through fourth embodiments of radiation elements have the same total radiation element length and the total number of meanders. The number of meanders in the lower arm 21 is zero in the radiation element of the first embodiment, is one in the radiation element of the second embodiment, is two in the radiation element of the third embodiment, and is three in the radiation element of the fourth embodiment.

Comparison experiments were carried out to examine the input characteristics of the first through fourth embodiments of radiation elements. The size of the ground plate 11 was 40 mm (width)×70 mm (height), the size of the radiation element 12 was 40 mm (width)×16 mm (height), the width of the metal strip forming the radiation element 12 was 2 mm, and the total length of the strip was the same in each of the structures.

Figure 5:
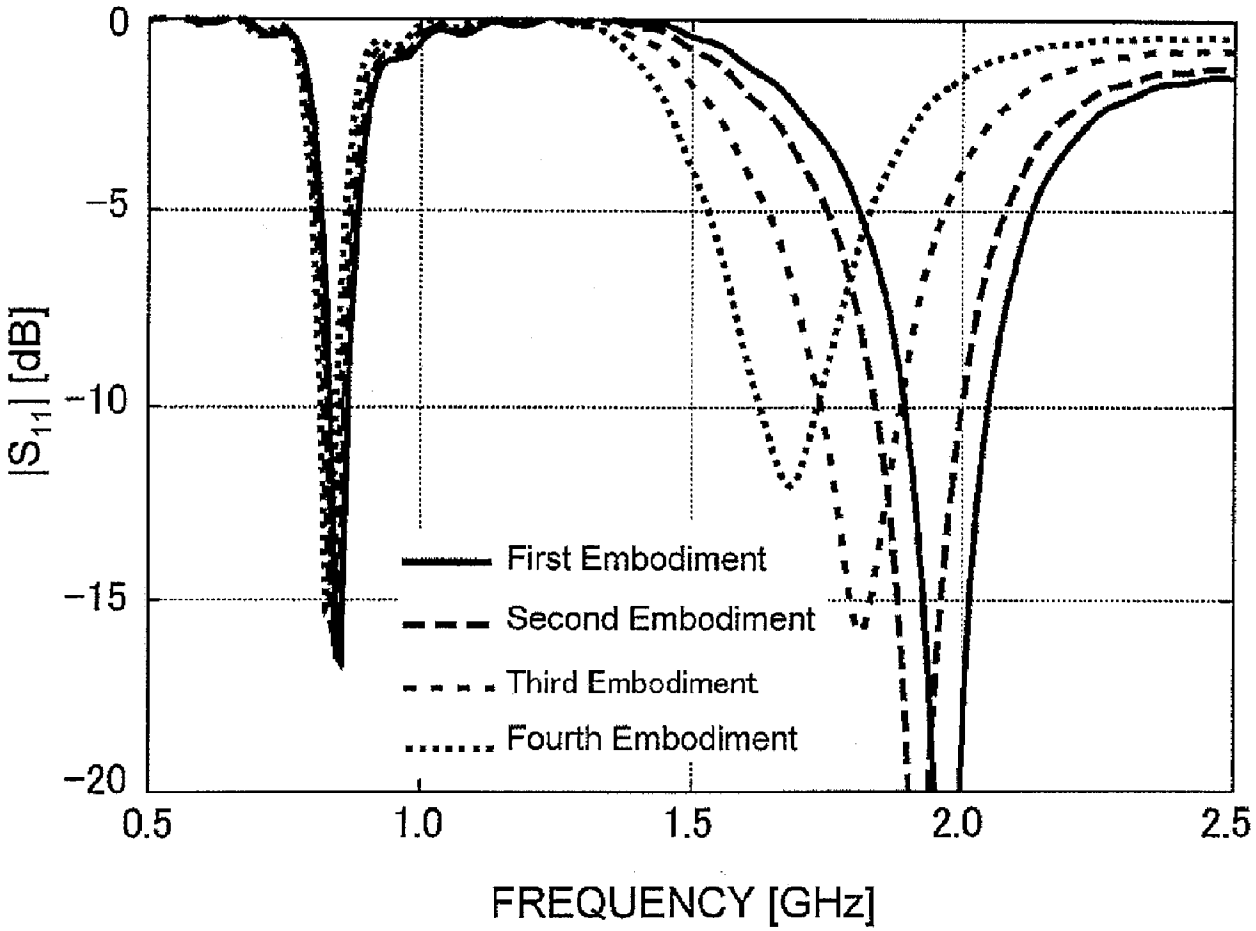
FIG. 5 shows the input characteristics of the radiation elements shown in FIG. 4.

FIG. 5 shows the input characteristics of the radiation elements illustrated in FIG. 4. As can be seen from the radiation element of the fourth embodiment, the second operating frequency shifts to the low frequency side from the situation seen in the first embodiment. Accordingly, where the total length of each radiation element and the total number of meanders are fixed, the second operating frequency (the high-order resonance) can be made lower by placing a larger number of meanders in the lower arm, without a change in the first operating frequency (the fundamental resonance). With the use of the principles, the antenna according to this embodiment can be used in multibands.

Figure 6:
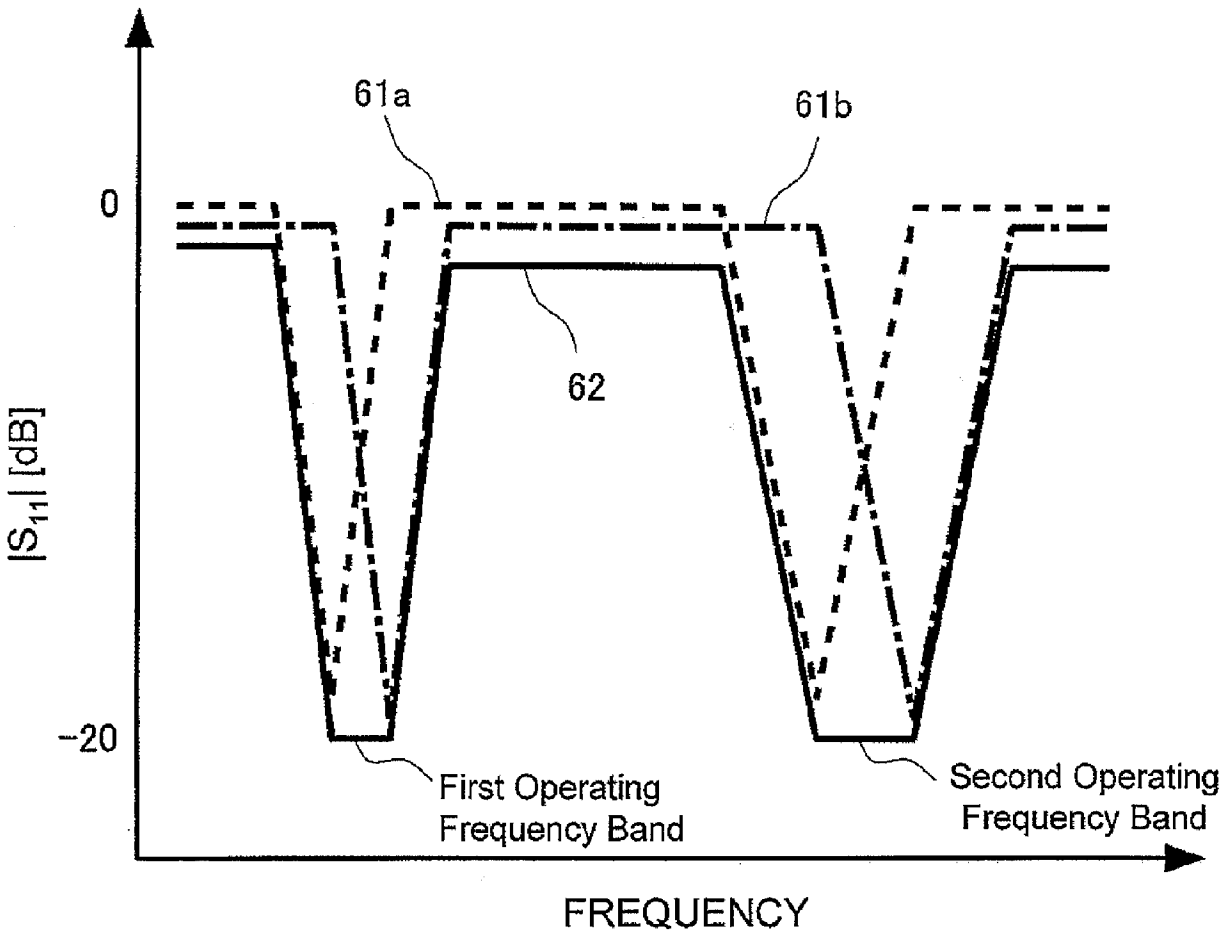
FIG. 6 shows comparative examples of input characteristics observed in cases where one radiation element is used and in a case where two radiation elements are used.

FIG. 6 shows comparative examples of input characteristics observed in cases where one radiation element is used and in a case where two radiation elements are used. Reference numeral 61*a* represents the input characteristics of an antenna formed only with the radiation element 12*a* shown in FIG. 2, reference numeral 61*b* represents the input characteristics of an antenna formed only with the radiation element 12*b* shown in FIG. 2, and reference numeral 62 represents the input characteristics of an antenna including both the radiation element 12*a* and the radiation element 12*b* shown in FIG. 1. Here, the fundamental resonance frequency and high-order resonance frequency of the radiation element 12*a* are slightly different from the fundamental resonance frequency and high-order resonance frequency of the radiation element 12*b*. By using the antenna structure in which the two radiation elements 12*a* and 12*b* are arranged parallel to each other as shown in FIG. 1, the reflection loss $S_{11}$ can be reduced in the frequency band between the respective fundamental resonance frequencies of the radiation element 12*a* and the radiation element 12*b*, and in the frequency band between the respective high-order resonance frequencies of the radiation element 12*a* and the radiation element 12*b*. Thus, a wider operating frequency band can be realized.

However, when the two radiation elements 12*a* and 12*b* are connected, a mutual coupling is formed between the two radiation elements 12*a* and 12*b*. Therefore, the input characteristics of the antenna differ from the input characteristics of the antenna formed only with the radiation element 12*a* and the antenna formed only with the radiation element 12*b*. In view of this, it is preferable to adjust the sizes of and the distance between the radiation element 12*a* and the radiation element 12*b* in this embodiment.

In the antenna according to this embodiment, the position of the distribution of the current contributing to radiation can be changed by adjusting the positions of meanders. Accordingly, the directivity of radiation characteristics can be adjusted. Thus, the antenna according to this embodiment can be adjusted, so that matching can be achieved in a desired operating frequency band, and nondirectional radiation characteristics can be achieved.

A wireless communication apparatus according to this embodiment includes the antenna according to this embodiment described so far. The wireless communication apparatus may be a mobile phone handset, a PDA (Personal Digital Assistant), or a notebook PC (Personal Computer), for example. The antenna according to this embodiment can be used in multibands. For example, the operating frequency bands of multibands mounted on mobile phone handsets include AMPS (824 to 894 MHz), GSM (880 to 960 MHz), DCS (1710 to 1880 MHz), PCS (1850 to 1990 MHz), and UMTS (1920 to 2170 MHz). Accordingly, the wireless communication apparatus according to this embodiment can efficiently transmit and receive radio signals.

This antenna can be used in two operating frequency bands. Particularly, this antenna can cover AMPS, GSM, DCS, PCS, and UTMS, which are the bands used by mobile phone handsets. Since two connected radiation elements are used, this antenna enables wideband operations that cannot be performed by other antennas.

Also, if necessary, this antenna may be modified so as to be mounted in a narrow space in a wireless communication apparatus.

Furthermore, if this antenna is formed with metals films or metal wires, antennas can be manufactured at very low costs.

Example 1

The characteristics of the antenna illustrated in FIG. 1 were measured.

In this example, the radiation element 12*a*, the radiation element 12*b*, and the shorting pin 13 were formed with metal films. The distance S between the radiation elements 12*a* and 12*b* was 5 mm, the arm width W_12 and intervals S_12 of the radiation element 12*a* and the radiation element 12*b* were 2 mm, the height H_12*a* of the radiation element 12*a* was 12 mm, the height H_12*b* of the radiation element 12*b* was 10 mm, the distance S_12*a* between the radiation element 12*a* and the ground plate 11 was 3 mm, the width W_13 of the shorting pin 13 was 10 mm, and the width W_11 and height H_11 of the ground plate 11 were 40 mm and 70 mm, respectively.

Figure 8:
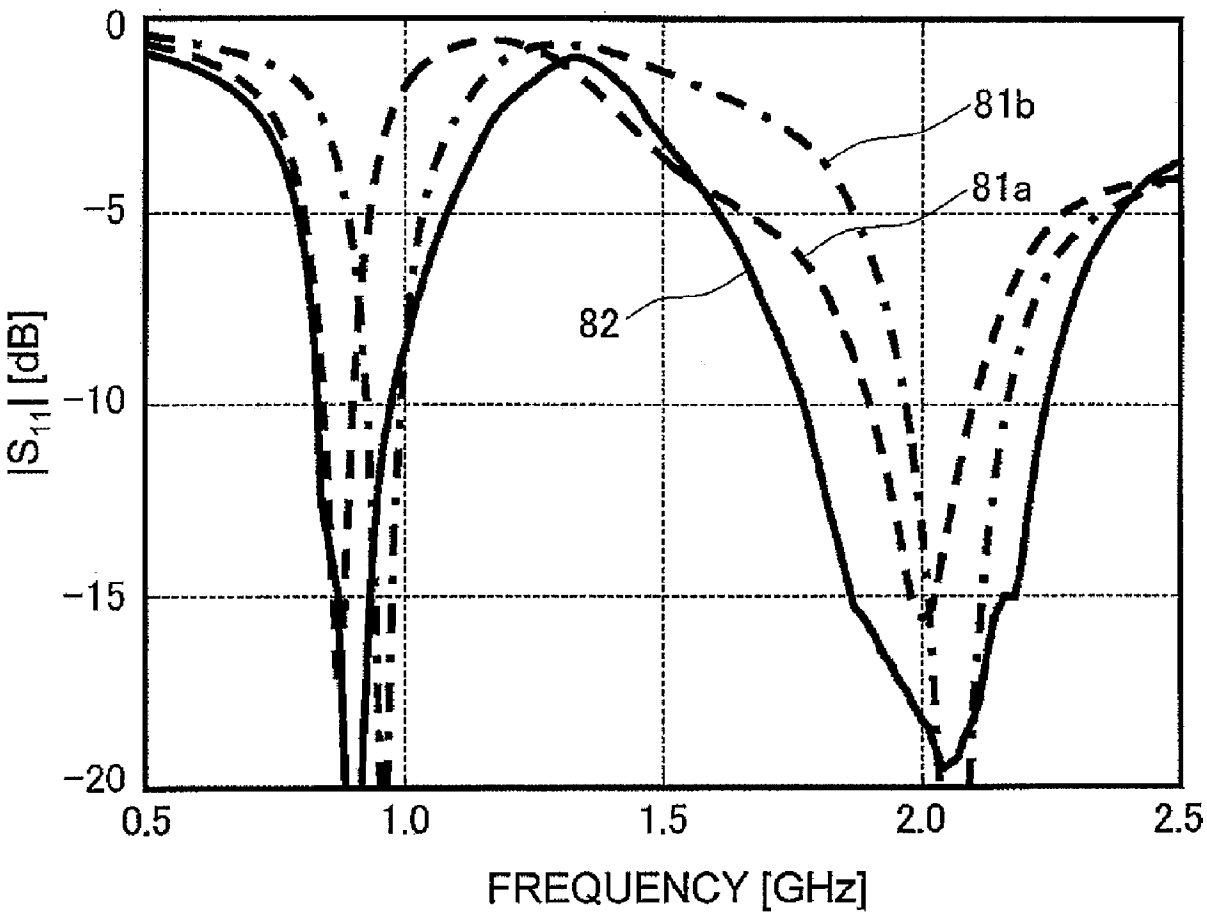
FIG. 8 shows comparative examples of input characteristics observed in cases where one radiation element is used and in a case where two radiation elements are used.

FIG. 8 shows comparative examples of input characteristics observed in cases where one radiation element was used and in a case where two radiation elements were used. Reference numeral 81*a* represents the input characteristics observed in a case where the radiation element 12*a* shown in FIG. 2 was used, reference numeral 81*b* represents the input characteristics observed in a case where the radiation element 12*b* shown in FIG. 2 was used, and reference numeral 82 represents the input characteristics observed in a case where the two radiation elements 12*a* and 12*b* shown in FIG. 1 were used. The input characteristics 82 have a wider operating frequency band than the operating frequency bands of the input characteristics 81*a* and the input characteristics 81*b*.

Figure 9:
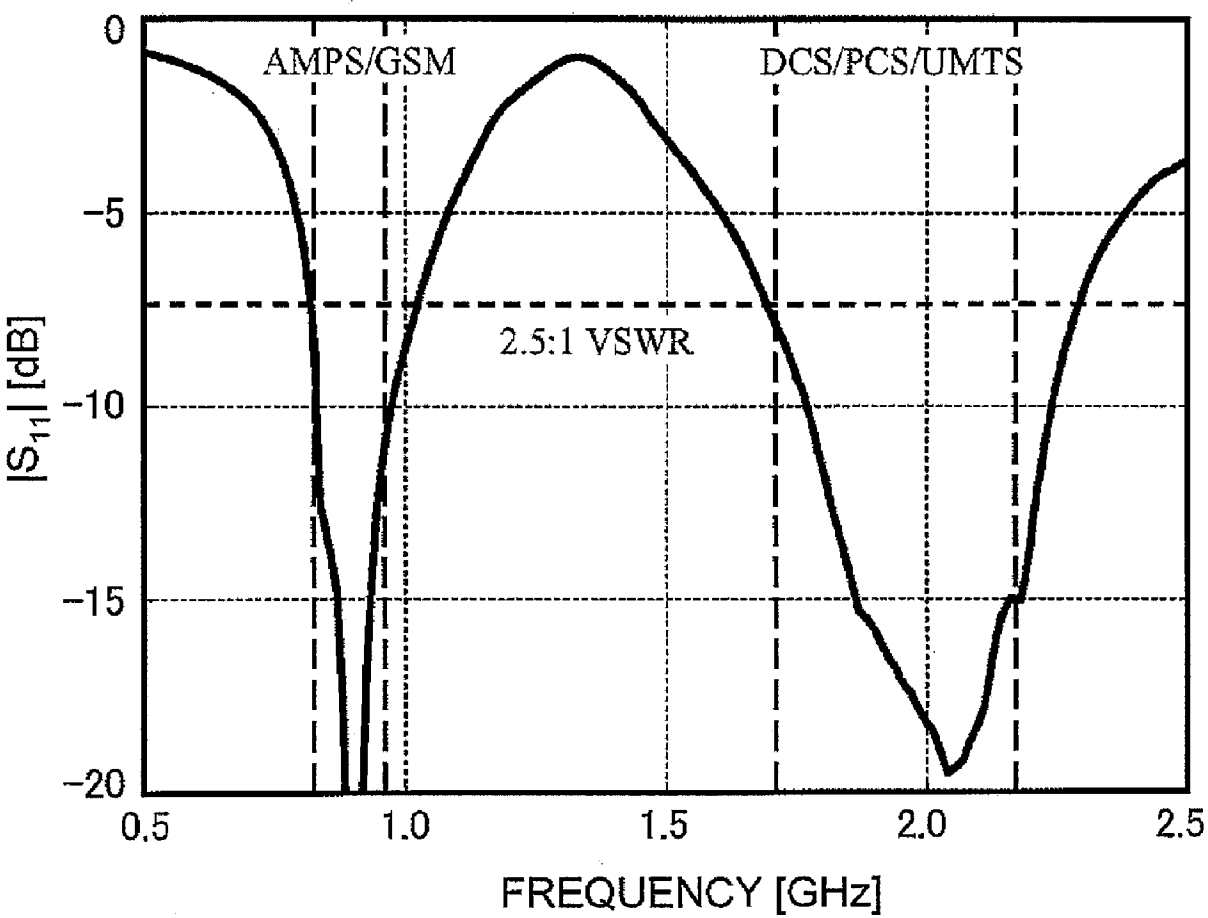
FIG. 9 shows the input characteristics of the antenna according to Example 1.

FIG. 9 shows the input characteristics of an antenna according to Example 1. As shown in FIG. 9, in this antenna, each band is covered when the VSWR (Voltage Standing Wave Ratio) is 2.5 or lower. The fractional bandwidth of the first operating frequency is 22%, which covers the AMPS and GMPS bands. The fractional bandwidth of the second operating frequency is 29%, which covers the DCS, PCS, and UMTS bands. Here, the fractional bandwidth R is defined by the following equation:

$$R=2(f_H-f_L)/(f_H+f_L)$$

where $f_L$ and $f_H$ represent the lowest frequency and the highest frequency in the operating frequency band, respectively.

Figure 7B:
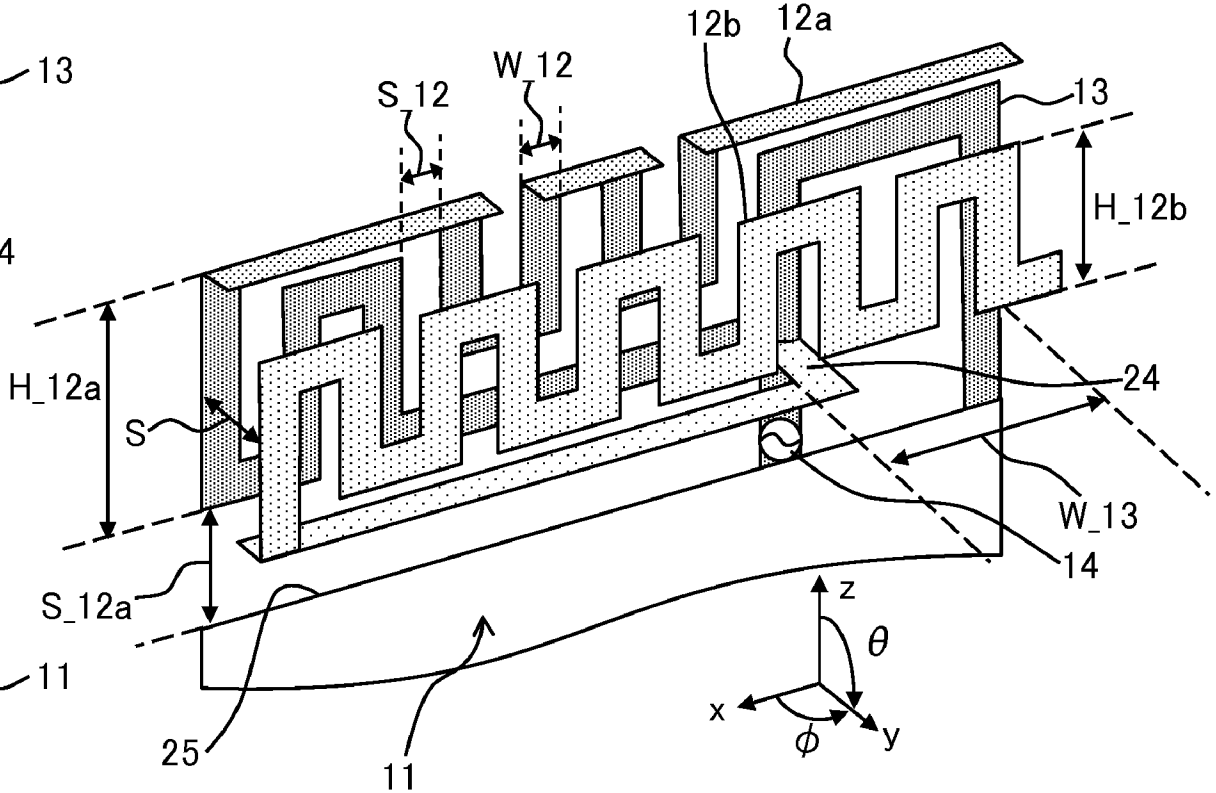
FIG. 7 is a schematic view showing the structure of an antenna according to Example 1.
Figure 7A:
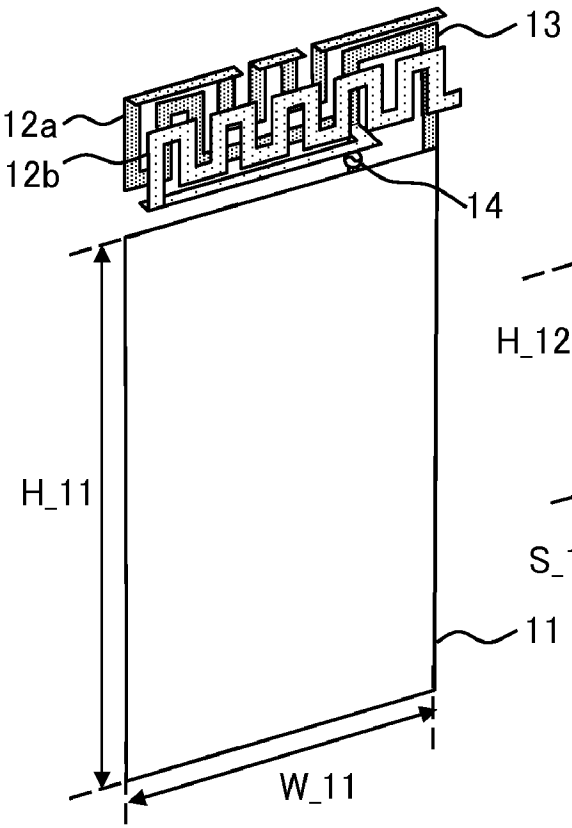
Figure 10A:
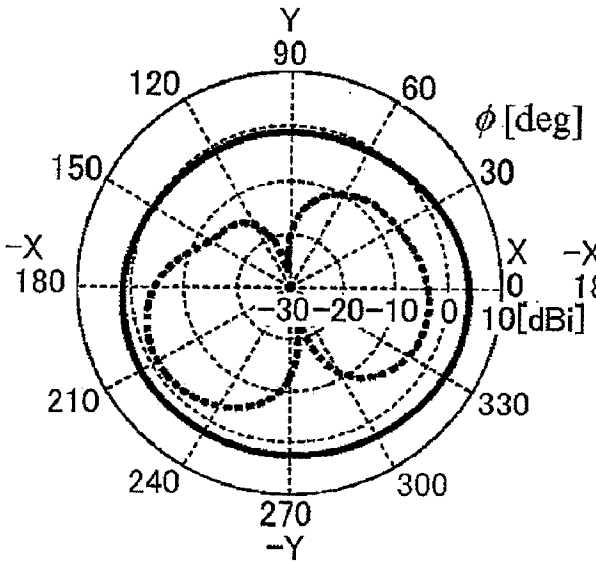
FIG. 10(A) shows the x-y plane.
Figure 10B:
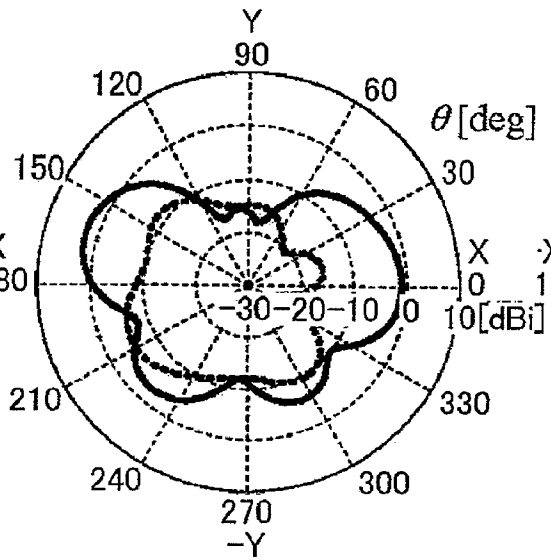
FIG. 10(B) shows the x-z plane.
Figure 10C:
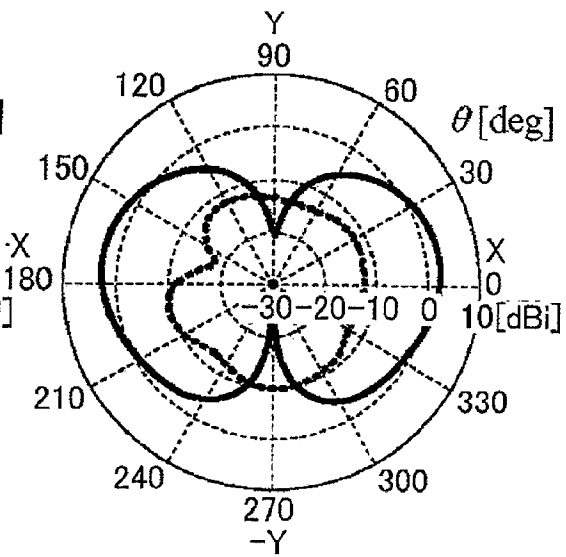
FIG. 10(C) shows the y-z plane.
Figure 11A:
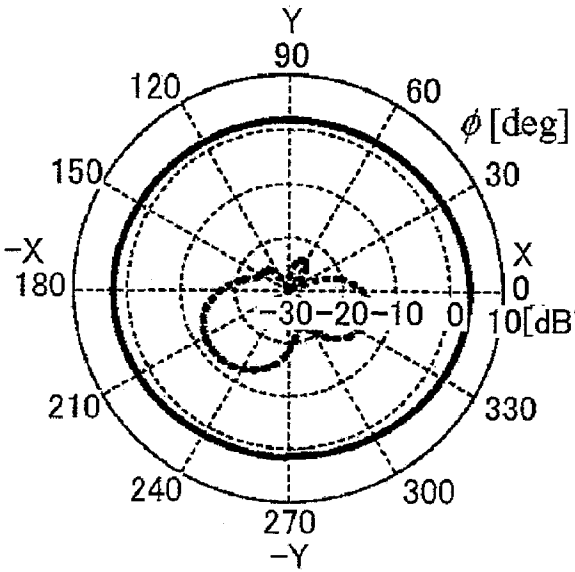
FIG. 11(A) shows the x-y plane.
Figure 11B:
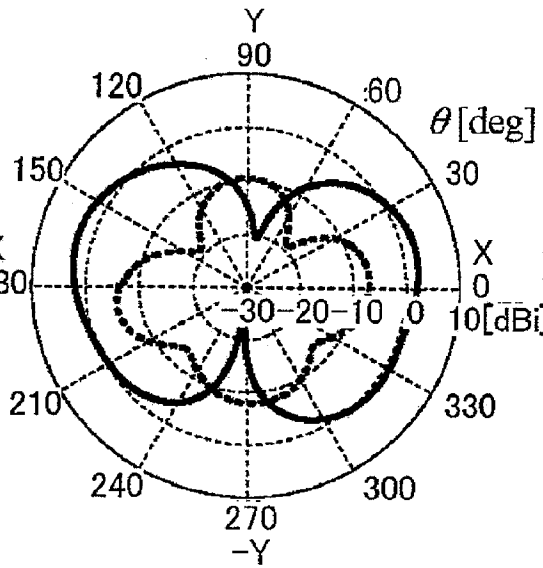
FIG. 11(B) shows the x-z plane.
Figure 11C:
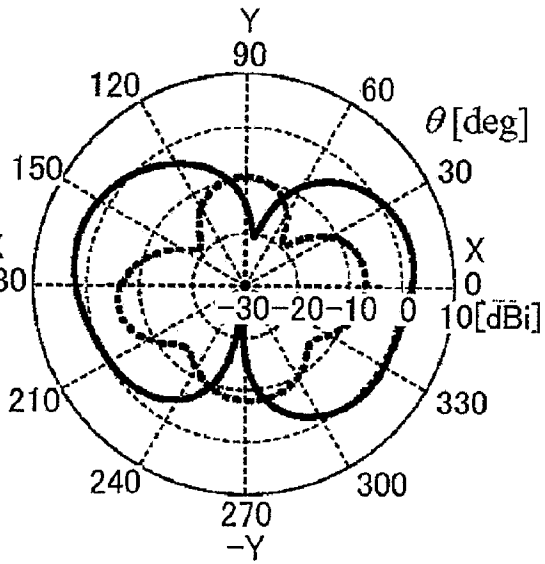
FIG. 11(C) shows the y-z plane.
Figure 12A:
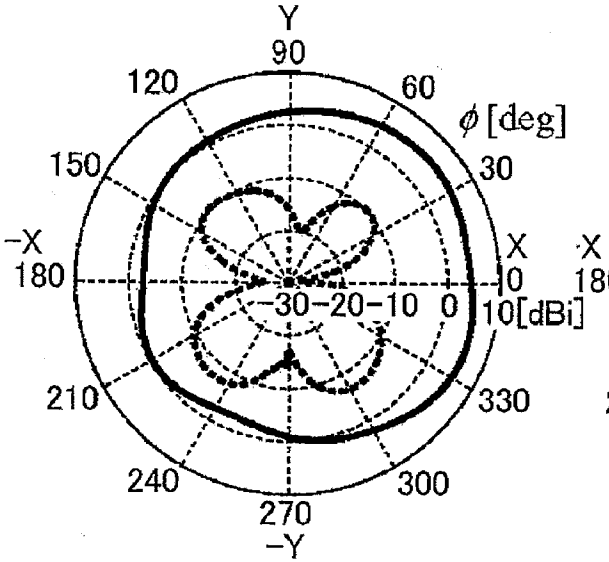
FIG. 12(A) shows the x-y plane.
Figure 12B:
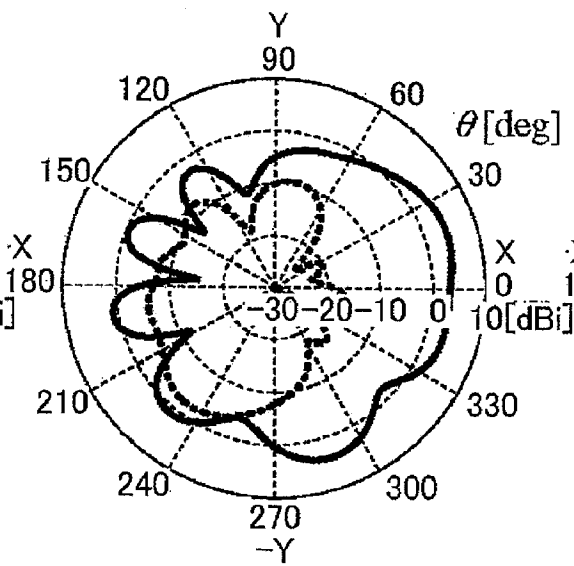
FIG. 12(B) shows the x-z plane.
Figure 12C:
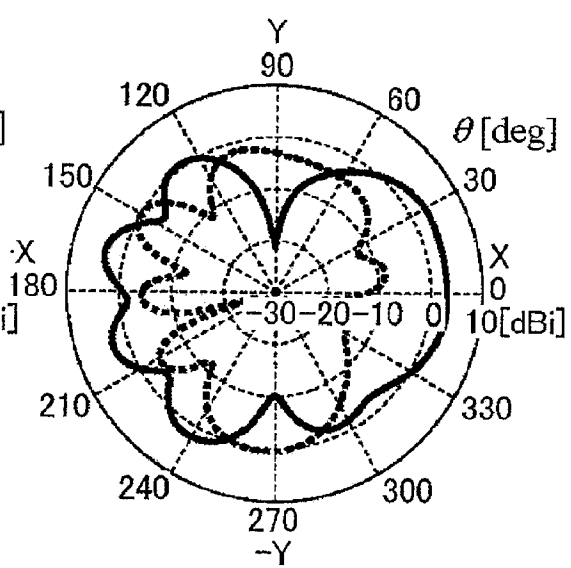
FIG. 12(C) shows the y-z plane.
Figure 13A:
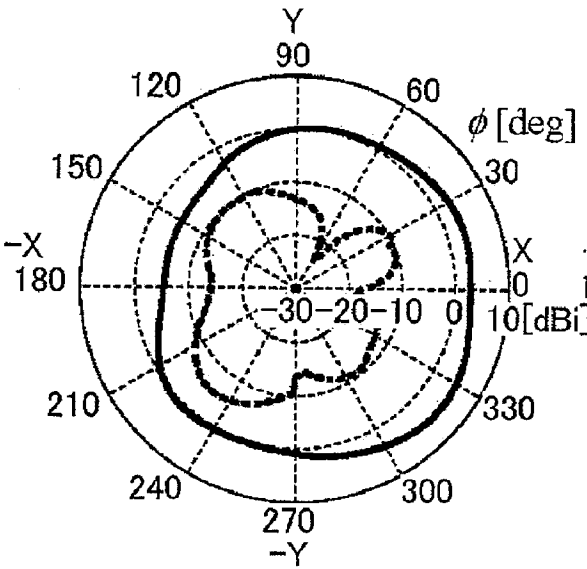
FIG. 13(A) shows the x-y plane.
Figure 13B:
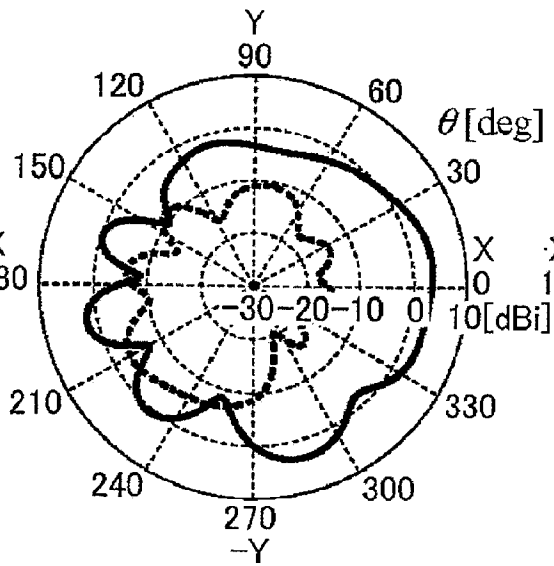
FIG. 13(B) shows the x-z plane.
Figure 13C:
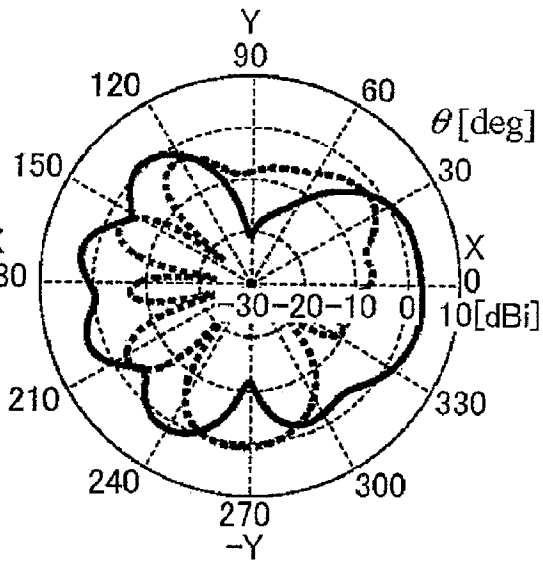
FIG. 13(C) shows the y-z plane.
Figure 14A:
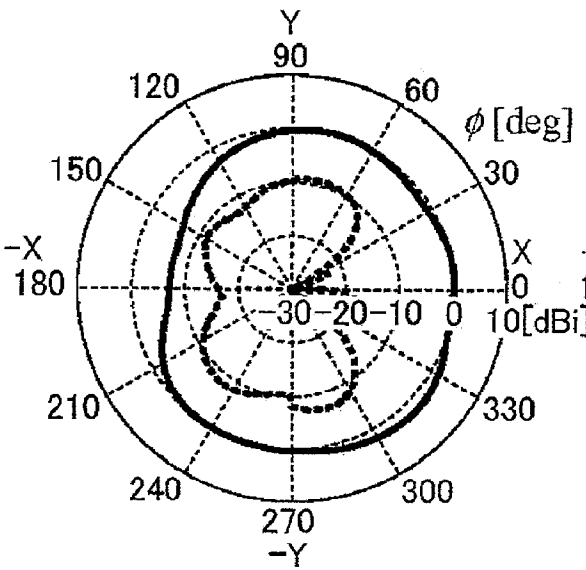
FIG. 14(A) shows the x-y plane.
Figure 14B:
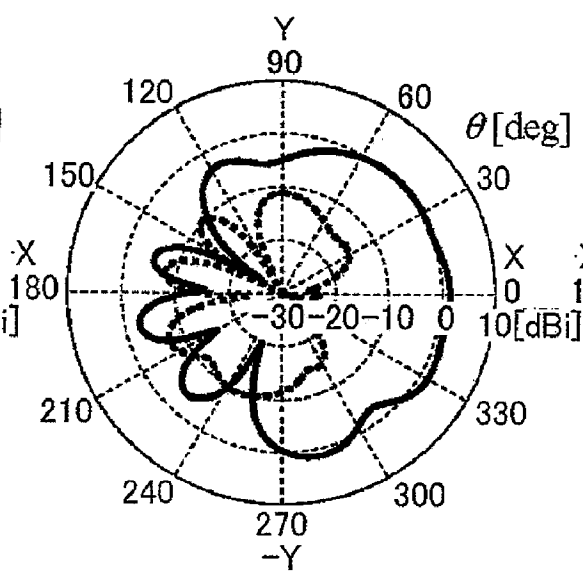
FIG. 14(B) shows the x-z plane.
Figure 14C:
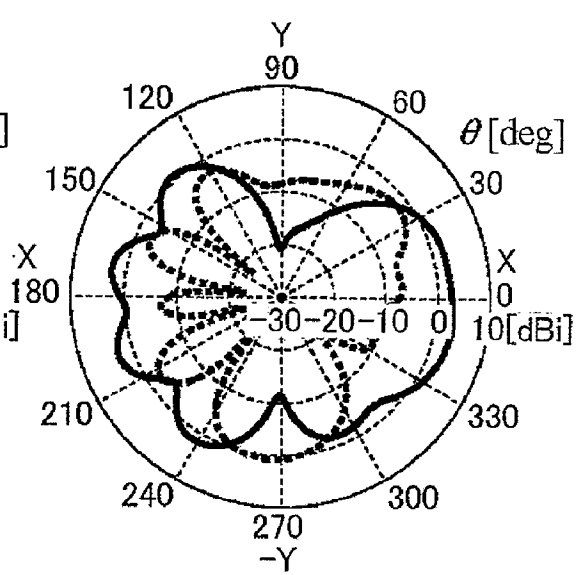
FIG. 14(C) shows the y-z plane.

FIG. 10, FIG. 11, FIG. 12, FIG. 13, and FIG. 14 show the radiation characteristics of the antenna according to Example 1. FIG. 10 shows the radiation characteristics of the antenna according to this example at the frequency of 0.860 GHz. FIG. 11 shows the radiation characteristics of the antenna according to this example at the frequency of 0.920 GHz. FIG. 12 shows the radiation characteristics of the antenna according to this example at the frequency of 1.795 GHz. FIG. 13 shows the radiation characteristics of the antenna according to this example at the frequency of 1.920 GHz. FIG. 14 shows the radiation characteristics of the antenna according to this example at the frequency of 2.045 GHz. FIG. 10(A), FIG. 11(A), FIG. 12(A), FIG. 13(A), and FIG. 14(A) each show the x-y plane. FIG. 10(B), FIG. 11(B), FIG. 12(B), FIG. 13(B), and FIG. 14(B) each show the x-z plane. FIG. 10(C), FIG. 11(C), FIG. 12(C), FIG. 13(C), and FIG. 14(C) each show the y-z plane. Each solid line indicates the radiation gain observed in a case where the electric field shown in FIG. 7 has a θ-direction component, and each broken line indicates the radiation gain observed in a case where the electric field has a ϕ-direction component. The results of the measurement of radiation characteristics show that the antenna at each operating frequency is substantially a nondirectional antenna, as shown in FIG. 10, FIG. 11, FIG. 12, FIG. 13, and FIG. 14.

Example 2

An antenna that has the same structure as that of the antenna of Example 1 but has a shorter distance S between the radiation element 12*a* and the radiation element 12*b* was formed. The distance S between the radiation elements 12*a* and 12*b* was 3 mm, and the height H_12*a* of the radiation element 12*a* was 14 mm.

As in Example 1, the input characteristics and radiation characteristics of the antenna were measured. As a result, it became apparent that the fractional bandwidths of the first operating frequency and the second operating frequency were 20% and 28%, respectively, which also cover the AMPS, GMPS, DCS, PCS, and UMTS bands. The radiation pattern was almost the same as that of Example 1.

Example 3

Figure 15:
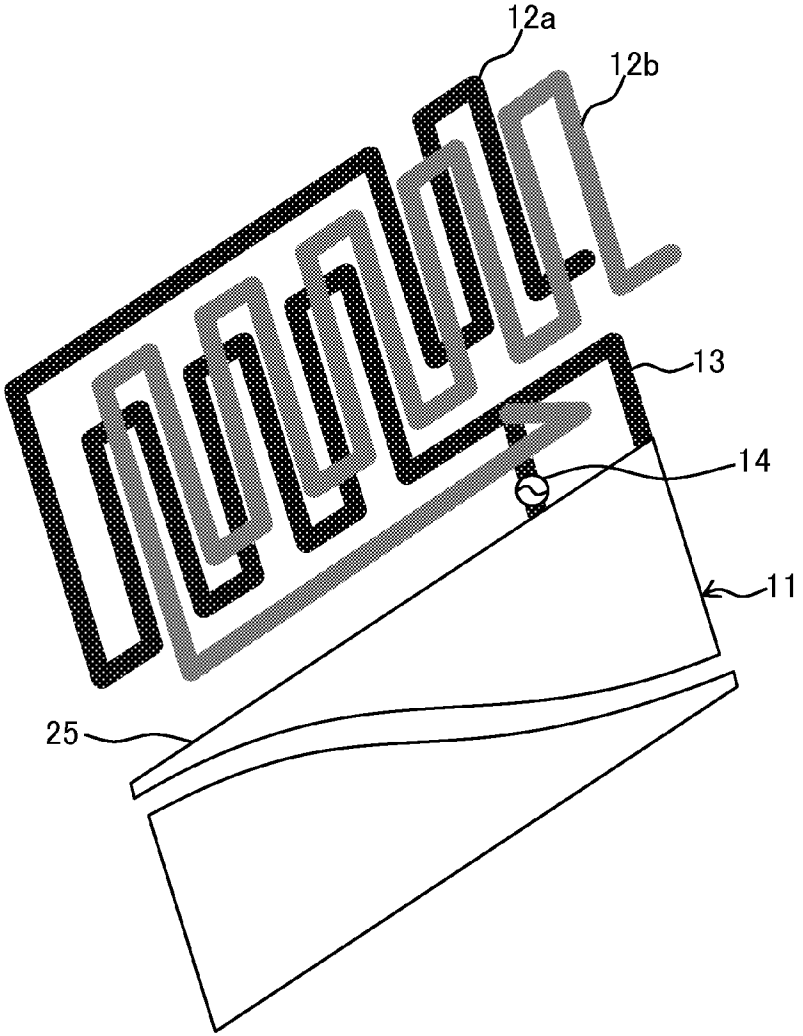
FIG. 15 is a schematic view showing the structure of an antenna according to Example 3.

FIG. 15 is a schematic view of the structure of an antenna according to this example. In this example, the radiation element 12*a*, the radiation element 12*b*, and the shorting pin 13 were formed with metal wires. In the antenna of this example, the radiation element 12*a* does not have the bent portion 23*a* shown in FIG. 1, unlike the radiation element 12*a* of Example 1.

The characteristics of the antenna according to this example were substantially the same as those of Example 1 and Example 2. The same characteristics as those of Example 1 and Example 2 can be achieved by appropriately setting the arm width W_12 and arm intervals S_12 of the radiation element 12*a* and the radiation element 12*b*, and the shapes of the radiation element 12*a* and the radiation element 12*b* shown in FIG. 7.

Example 4

Figure 16:
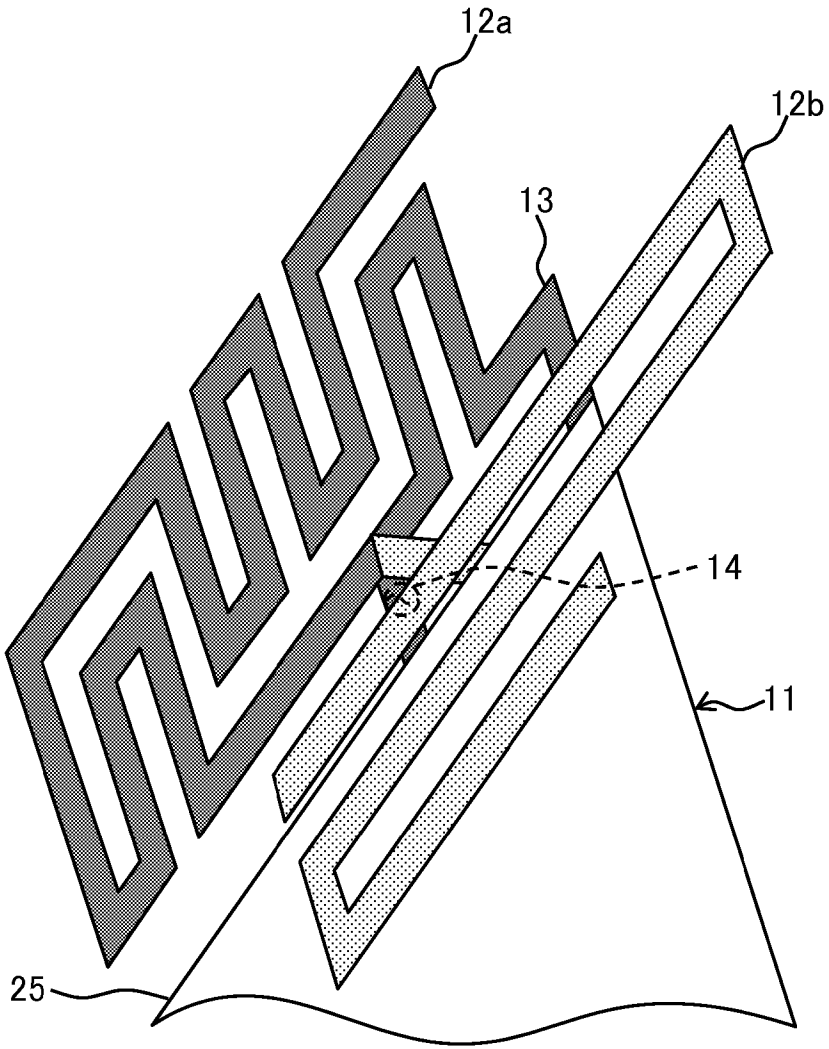
FIG. 16 is a schematic view showing the structure of an antenna according to Example 4.

FIG. 16 is a schematic view showing the structure of an antenna according to this example. In this example, the meandered structures shown in FIG. 1 and FIG. 2 are perpendicular to each other between the radiation element 12*a* and the radiation element 12*b*. Here, the meandered structures are arranged parallel or perpendicular to the nearest edge of the ground plate 11. The input characteristics and radiation characteristics of the antenna according to this example were as good as those of Example 1 and Example 2.

Example 5

Figure 17:
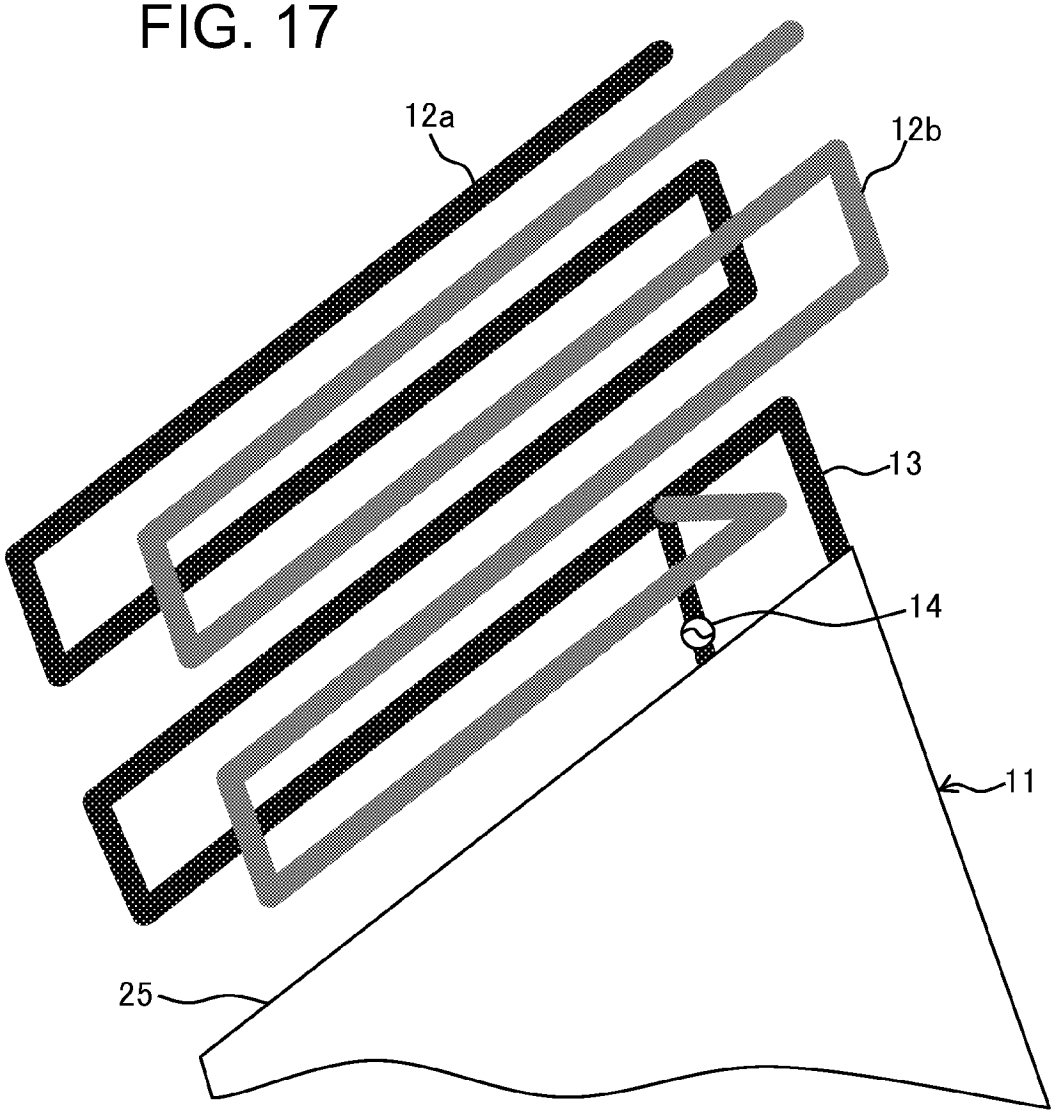
FIG. 17 is a schematic view showing the structure of an antenna according to Example 5.

FIG. 17 is a schematic view showing the structure of an antenna according to this example. In this example, the meandered structures shown in FIG. 1 and FIG. 2 are arranged parallel to the nearest edge of the ground plate 11. The input characteristics and radiation characteristics of the antenna according to this example were as good as those of Example 1 and Example 2.

Example 6

Figure 18:
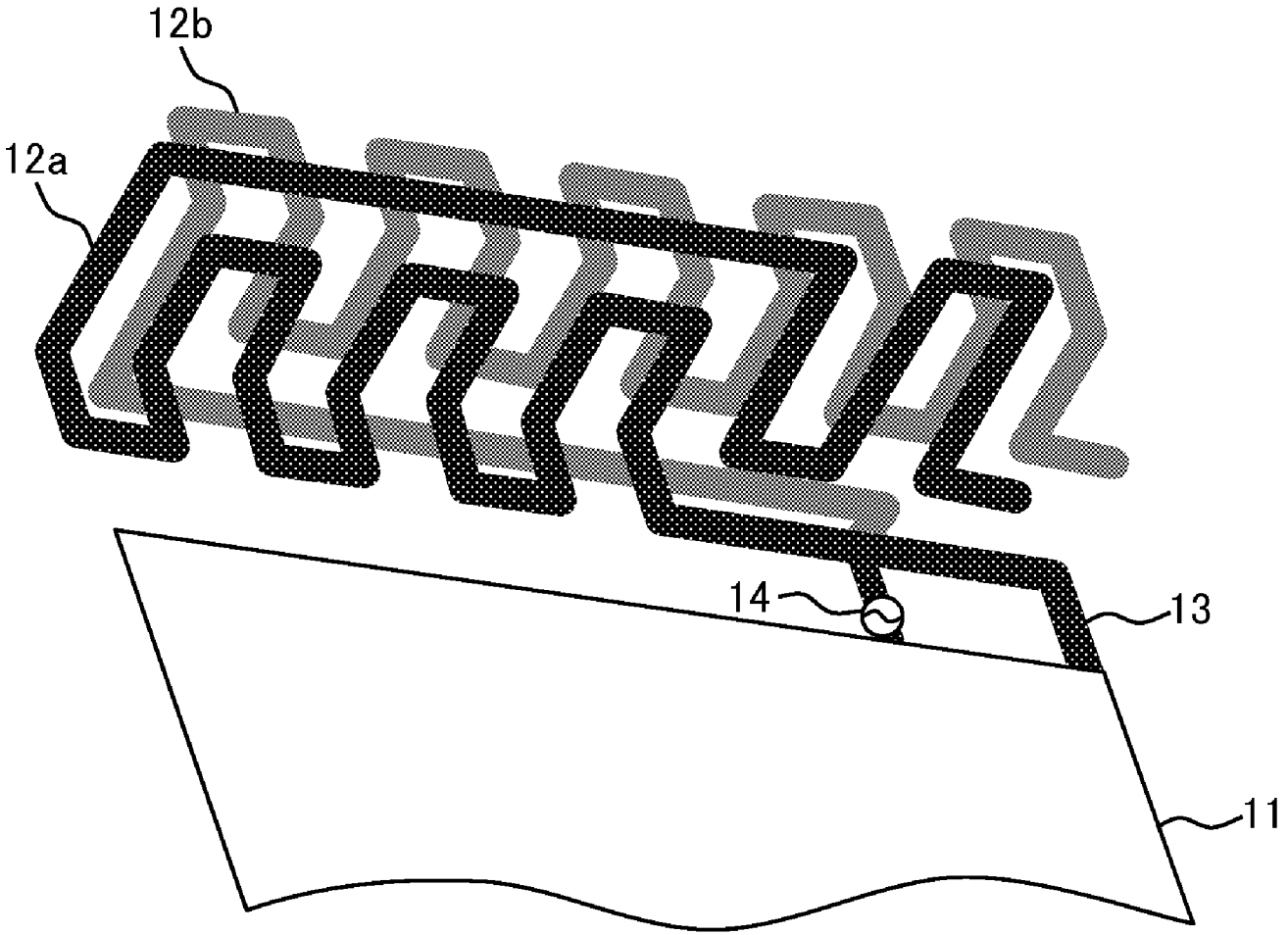
FIG. 18 is a schematic view showing the structure of an antenna according to Example 6.

FIG. 18 is a schematic view showing the structure of an antenna according to this example. In this example, the face having the largest area in the two radiation elements 12*a* and 12*b* shown in FIG. 1 and FIG. 2 is placed perpendicular to the ground plate 11. It is preferable that the relative positions of the radiation element 12*a*, the radiation element 12*b*, and the ground plate 11 are changed, if necessary. The input characteristics and radiation characteristics of the antenna according to this example were as good as those of Example 1 and Example 2.

Example 7

Figure 19:
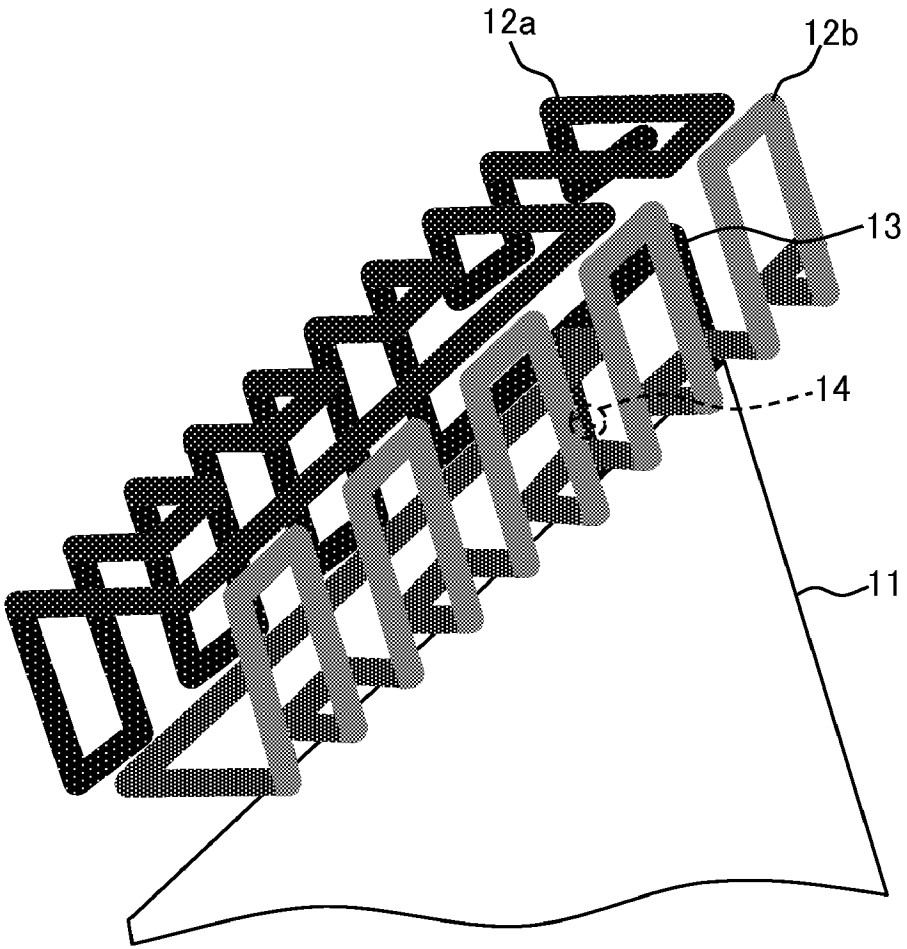
FIG. 19 is a schematic view showing the structure of an antenna according to Example 7.

FIG. 19 is a schematic view showing the structure of an antenna according to this example. In this example, each cross section perpendicular to the extending direction of the lower arm 21*a* and the lower arm 21*b*, and the upper arm 22*a* and the upper arm 22*b* shown in FIG. 1 and FIG. 2 has substantially a square shape. The input characteristics and radiation characteristics of the antenna according to this example were as good as those of Example 1 and Example 2.

Example 8

Figure 20:
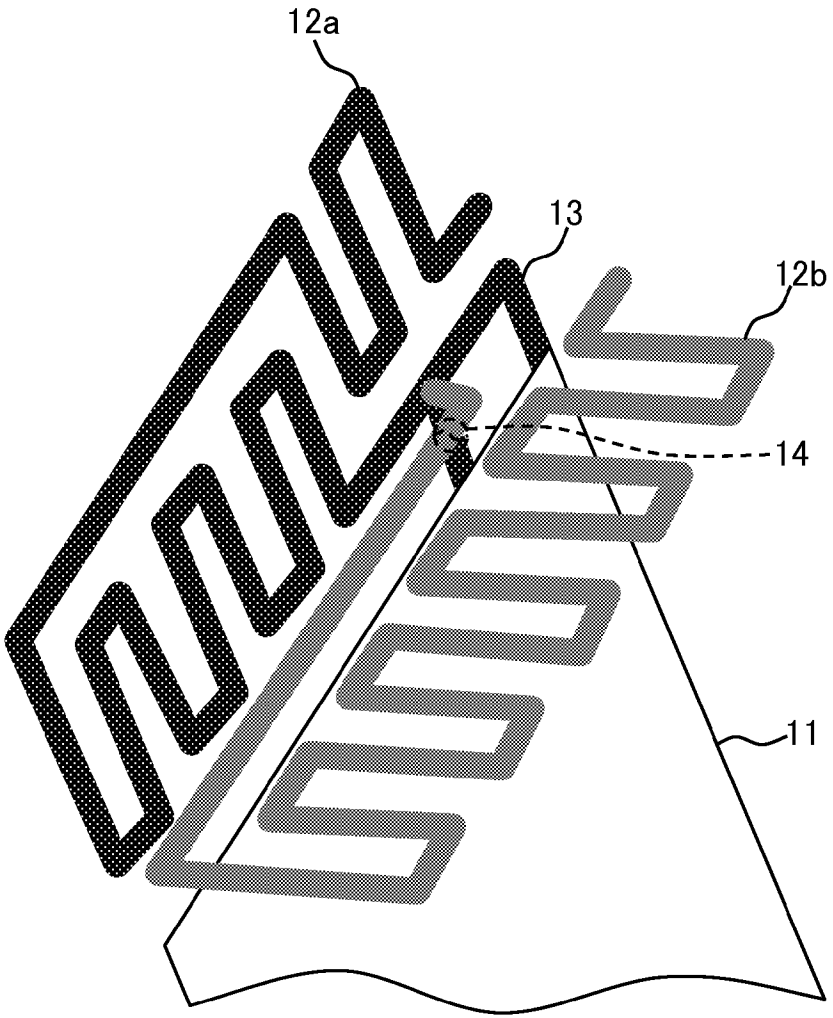
FIG. 20 is a schematic view showing the structure of an antenna according to Example 8.

FIG. 20 is a schematic view showing the structure of an antenna according to this example. In this example, the two radiation elements 12*a* and 12*b* shown in FIG. 1 and FIG. 2 have substantially planar structures, and are arranged perpendicular to each other. Further, the two radiation elements 12*a* and 12*b* have open forms. The input characteristics and radiation characteristics of the antenna according to this example were as good as those of Example 1 and Example 2.

In the above examples, even if the space between the radiation element 12*a* and the radiation element 12*b* was filled with a dielectric material, the same effects as those of Example 1 were achieved. Accordingly, the antenna according to this example may be wound around a dielectric material and mounted on a wireless communication apparatus. In such a case, the antenna can be made smaller in size, by virtue of the dielectric material.

INDUSTRIAL APPLICABILITY

The present invention relates to a multiband antenna for wireless communications. This antenna can be manufactured at very low costs, and can be mounted on wireless communication apparatuses such as mobile phone handsets, PDAs, and notebook PCs.

EXPLANATION OF REFERENCE NUMERALS

11: ground plate
12, 12*a*, 12*b*: radiation elements
13: shorting pin
14: feeding point
21, 21*a*, 21*b*: lower arms
22, 22*a*, 22*b*: upper arms
23*a*, 23*b*: bent portions
24: connecting portion
25: nearest edge of ground plate

The invention claimed is:

1. An antenna that has two radiation elements connected to a ground plate via a shorting pin, the two radiation elements each having a lower arm and an upper arm formed through bending, the lower arms of the two radiation elements being connected to the shorting pin and being located closer to the ground plate than the upper arms are, at least one of the lower arm and the upper arm of each of the two radiation elements having a meandered structure, wherein the lower arms and the upper arms extend along straight lines parallel to each other, and wherein at least one of the two radiation elements has a bent portion that is bent along a straight line parallel to the straight lines and toward the other one of the two radiation elements.

2. The antenna according to claim 1, wherein the two radiation elements each have substantially a planar structure, and are arranged parallel or perpendicular to each other.

3. The antenna according to claim 1, wherein the meandered structure is placed parallel or perpendicular to the nearest edge of the ground plate.

4. The antenna according to claim 1, wherein the two radiation elements are formed with metal films or metal wires.

5. The antenna according to claim 1, wherein the two radiation elements each have substantially a planar structure, and are fixed to a dielectric material.

6. The antenna according to claim 1, wherein a face having the largest area in the two radiation elements is placed parallel or perpendicular to the ground plate.

7. A wireless communication apparatus comprising the antenna according to claim 1.

8. An antenna that has two radiation elements connected to a ground plate via a shorting pin, the two radiation elements each having a lower arm and an upper arm formed through bending, the lower arms of the two radiation elements being connected to the shorting pin and being located closer to the ground plate than the upper arms are, the lower arm of each of the two radiation elements having a meandered structure.

* * * * *